US008401818B2

(12) United States Patent
Sato et al.

(10) Patent No.: US 8,401,818 B2
(45) Date of Patent: Mar. 19, 2013

(54) GOLF BALL MOVEMENT MEASURING APPARATUS

(75) Inventors: Fumiaki Sato, Saitama (JP); Wataru Ban, Saitama (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 1081 days.

(21) Appl. No.: 11/962,149

(22) Filed: Dec. 21, 2007

(65) Prior Publication Data

US 2008/0287208 A1 Nov. 20, 2008

(30) Foreign Application Priority Data

May 14, 2007 (JP) ..... 2007-127910

(51) Int. Cl.
*G01C 9/00* (2006.01)

(52) U.S. Cl. ..... 702/153

(58) Field of Classification Search ..... 473/199, 473/151, 219; 702/153
See application file for complete search history.

(56) References Cited

U.S. PATENT DOCUMENTS

| | | | | |
|---|---|---|---|---|
| 5,798,519 | A * | 8/1998 | Vock et al. | 250/206.1 |
| 6,042,483 | A | 3/2000 | Katayama | |
| 6,390,934 | B1 | 5/2002 | Winfield et al. | |
| 6,431,990 | B1 | 8/2002 | Manwaring | |
| 6,458,035 | B1 | 10/2002 | Katayama | |
| 2001/0029207 | A1* | 10/2001 | Cameron et al. | 473/151 |
| 2003/0202698 | A1* | 10/2003 | Simard et al. | 382/195 |
| 2004/0030527 | A1* | 2/2004 | Rankin | 702/153 |
| 2005/0054456 | A1 | 3/2005 | Gobush | |
| 2005/0261071 | A1* | 11/2005 | Cameron | 473/219 |

FOREIGN PATENT DOCUMENTS

| | | | |
|---|---|---|---|
| JP | 04269497 | | 9/1992 |
| JP | 06323852 | | 11/1994 |
| JP | 08122016 | | 5/1996 |
| JP | 08182786 | | 7/1996 |
| JP | 3037203 | U | 2/1997 |
| JP | 10-186474 | A | 7/1998 |
| JP | 2000-19186 | A | 1/2000 |
| JP | 2001054607 | A | 2/2001 |
| JP | 2002524223 | A | 8/2002 |
| JP | 2002-248189 | A | 9/2002 |
| JP | 2002248187 | A | 9/2002 |
| JP | 2003-6615 | A | 1/2003 |
| JP | 2004-24488 | A | 1/2004 |

(Continued)

OTHER PUBLICATIONS

Japanese Office Action issued Nov. 8, 2011 by the Japanese Patent Office in counterpart Japanese Application No. 2007-127910.
Japanese Office Action dated May 29, 2012 issued by the Japanese Patent Office in counterpart Japanese Application No. 2007-127910.

*Primary Examiner* — Omkar Deodhar
*Assistant Examiner* — Eric M Thomas
(74) *Attorney, Agent, or Firm* — Sughrue Mion, PLLC

(57) ABSTRACT

A golf ball movement measuring apparatus includes: a camera for taking a plurality of images of a golf ball hit by a golf club; a dark-colored background material which is disposed so as to configure a background of the golf ball in the images; and a processing unit to which the images are transmitted from the camera, the processing unit masking a background portion excepting the dark-colored background material in the images in black through image processing, and the processing unit analyzing a movement of the golf ball hit by the golf club.

5 Claims, 7 Drawing Sheets

FOREIGN PATENT DOCUMENTS

| | | | |
|---|---|---|---|
| JP | 2004164563 | A | 6/2004 |
| JP | 2005-91354 | A | 4/2005 |
| JP | 2005210666 | A | 8/2005 |
| JP | 2005529339 | A | 9/2005 |
| JP | 2006-505292 | A | 2/2006 |
| WO | 03/067524 | A2 | 8/2003 |
| WO | 03104838 | A1 | 12/2003 |
| WO | 2007037350 | A1 | 4/2007 |

* cited by examiner

GOLF BALL MOVEMENT MEASURING APPARATUS

BACKGROUND OF THE INVENTION

1. Field of the Invention

The present invention relates to a golf ball movement measuring apparatus for taking images of a golf ball hit by a golf club and analyzing a movement of the golf ball based on the images.

2. Description of the Related Art

A related art of a golf ball movement analyzing method for taking images of a golf ball hit by a golf club and analyzing a movement of the golf ball based on the images is described in JP-A-2003-6615. This is a method for automatically calculating a spatial relationship of a large number of dispersed dots on a golf ball, the method including: an automating step of obtaining at least one image of a ball at two or more separate times; an automating step of calculating an initial gray level of the images; an automating step of smoothing the images to binarized them; an automating step of positioning the number of balls in the images for measurement; an automating step of positioning the number of dispersed dots in each ball for measurement; an automating step of confirming that a calculated number of dots equals an expected number of dots in each ball; and an automating step of calculating a movement characteristic of the ball.

SUMMARY OF THE INVENTION

In the method of JP-A-2003-6615 which has been described above, however, the special golf ball has to be used on the surface of which the dispersed dots are printed in order to analyze the movement of the golf ball, and the method has not been such as to analyze a movement of a golf ball using a commercially available normal golf ball.

The invention has been made in view of these situations, and an object thereof is to provide a golf ball movement measuring apparatus for taking images of a golf ball hit by a golf club and analyzing a movement of the golf ball based on the images, wherein the movement of the golf ball can be analyzed using a commercially available normal golf ball.

According to the invention, there is provided a golf ball movement measuring apparatus including a camera for taking a plurality of images of a golf ball hit by a golf club; a dark-colored background material which is disposed so as to configure a background of the golf ball in the images; and a processing unit to which the images are transmitted from the camera, the processing unit masking a background portion excepting the dark-colored background material in the images in black through image processing, and the processing unit analyzing a movement of the golf ball hit by the golf club.

In this invention, in imaging the golf ball hit by the golf club by the camera, since the dark-colored (black, black brown or the like) background material is disposed in the portion which corresponds to the path of the moving golf ball that is estimated in advance, it becomes possible to image the moving golf ball clearly. In addition, in the invention, since the background portion of the golf ball which excludes the background material is masked with the black color through image processing, the background portion of the golf ball in the images can be darkened irrespective of actual colors of backgrounds. Consequently, in the invention, the processing unit fails in no case to identify erroneously, for example, the contour of the golf ball or a letter, number or symbol written on the golf ball which constitutes a target mark for analysis of the movement of the golf ball and hence, the movement of the golf ball hit by the golf ball can be analyzed by the processing unit. Due to this, according to the invention, the movement of the golf ball can be analyzed by making use of the contour of the golf ball or the letter, number or symbol formed on the golf ball without using any special golf ball.

As the movement of the golf ball which is to be measured by the golf ball movement measuring apparatus according to the invention, for example, in the case of the golf club being a putter, locus, speed and angular velocity of the golf ball are used, whereas in the case of the golf club being other than the putter, initial velocity, launch angle (upward angle relative to a horizontal line, lateral angle relative to a reference line), backspin amount and sidespin amount of the golf ball are used.

According to the golf ball movement measuring apparatus according to the invention, the movement of a golf ball can be analyzed by using a commercially available normal golf ball without using any special golf ball such as one on the surface of which a target mark for analysis of the movement thereof is written.

DETAILED DESCRIPTION OF THE EMBODIMENTS

Figure 1:
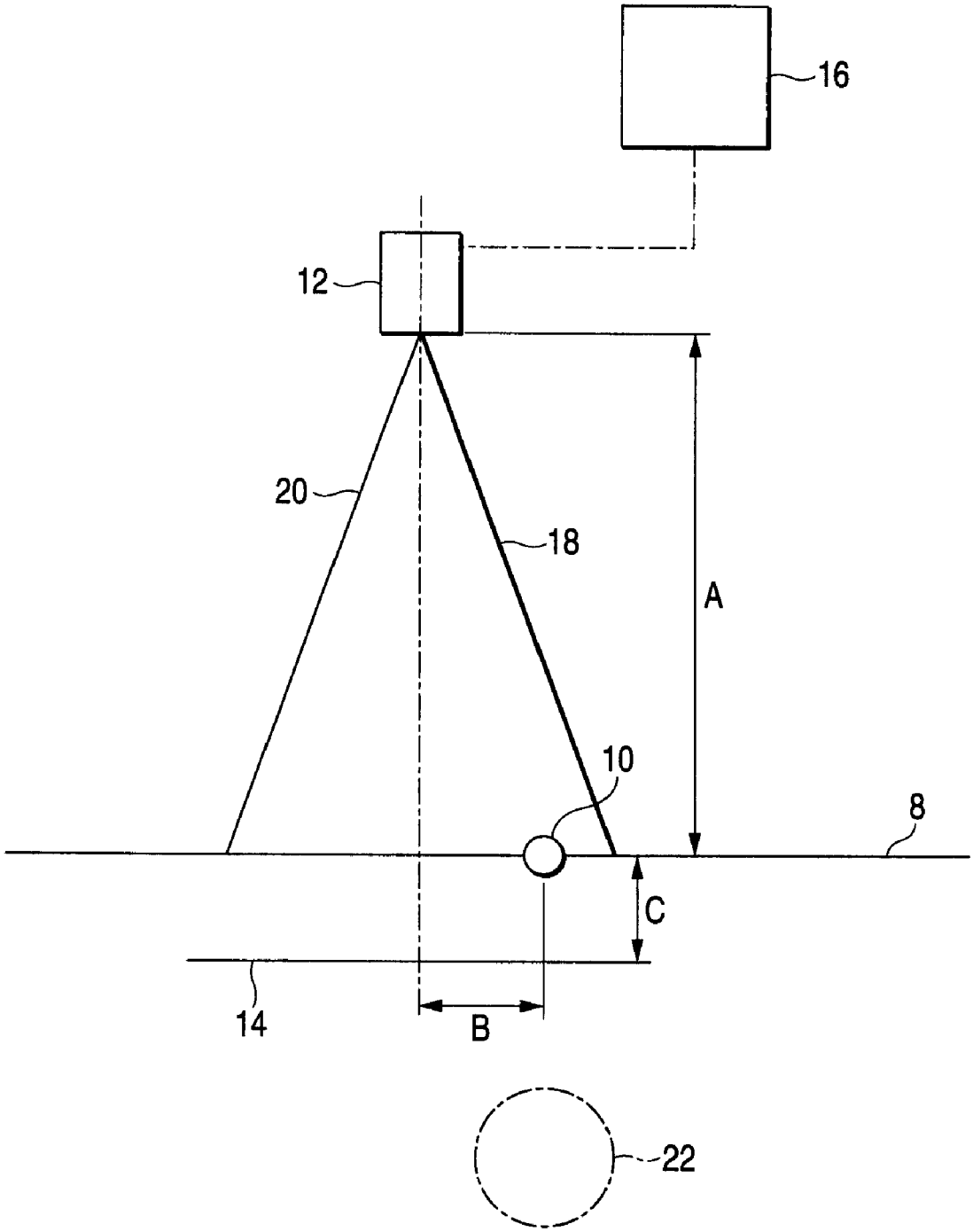
FIG. 1 is a layout diagram of an example of a golf ball movement measuring apparatus according to the invention as viewed from the top.

Hereinafter, while an embodiment of the invention will be described by reference to the drawings, the invention is not such as to be limited to what will be described below. FIG. 1 is a layout diagram resulting when a golf ball movement measuring apparatus according to the invention is viewed from the top.

A golf ball movement measuring apparatus of the embodiment includes a camera 12 for taking images of a golf ball 10 hit by a golf club (in this embodiment, a putter, not shown), a dark-colored background material 14 which is disposed so as to constitute a background of the golf ball in the images, and a computer (a processing unit) 16 with a monitor which is connected to the camera. In this embodiment, a distance A between the golf ball 10 and the camera 12 is about 700 to 900 mm, a distance B between the center of the golf ball 10 and the center of the camera 12 is about 120 to 140 mm, and a distance C between the center of the golf ball 10 and the background material 14 is about 110 to 130 mm. In addition, in FIG. 1, reference numeral 8 denotes an imaginary line of an ideal path of a moving putter and that of a moving golf ball.

The camera 12 is a high-speed video camera (a CCD camera) which can take 150 to 350 images per second, and a space between lines 18, 20 denotes an imaging range by the camera 12. Since general video cameras are such as to take 30 to 60 images per second, the high-speed vide camera is such as to take images at quite high speeds. A lens whose focal length is in the range of 6 to 35 mm is used in order to enable the imaging in a wide angle range to a standard range. Further, it is preferable that the focal ratio of the lens is about F 1.0 to F 4.5 because golf balls are imaged inside a building in some cases, while golf balls are imaged outside a building using an electronic flash in other cases.

In addition, in this embodiment, images are made to be transmitted from the camera 12 directly to a memory within the computer 16 without an external memory being interposed between the camera 12 and the computer 16. This is because in the event that an external memory is used, the image transmitting speed becomes slow, whereby the computer 16 is made difficult to be used to such an extent that real time analysis becomes impossible. As the method for transmitting images from the camera 12 directly to the memory within the computer 16, for example, an approach can be raised in which the Camera Link (the high-speed serial data transmission standard) is used which is a serial interface for enabling a high speed data transmission.

The background material 14 is a plate material which is painted in a matt dark color (black, black brown or the like) and is disposed perpendicularly between the golf ball 10 and a position 22 where a golfer stands or addresses a ball. The height of the background material 14 is on the order of 10 cm which is larger than the diameter of a golf ball, and the background material 14 is disposed so as to be imaged and shown throughout the monitor of the computer 16 in a width direction of the monitor. In addition, since an image is largely distorted towards edge areas of a monitor screen, the background material 14 is disposed so as to be imaged and displayed substantially in a vertically central area of the monitor screen.

Figure 2:
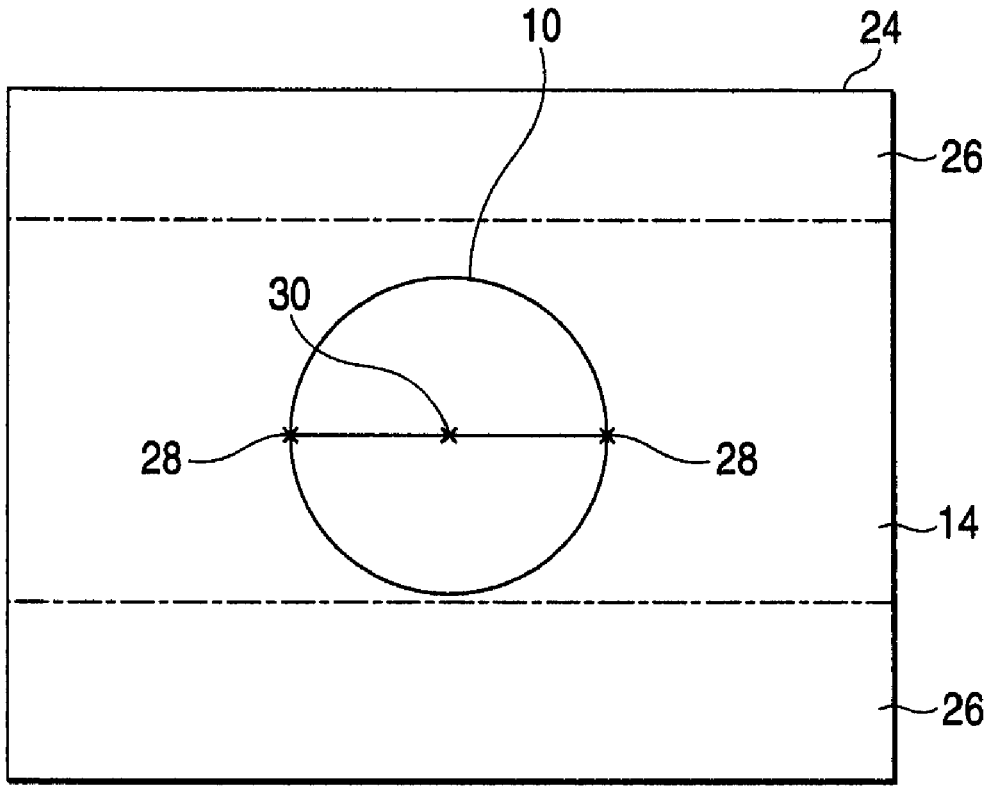
FIG. 2 is a schematic diagram showing a monitored image of a golf ball.

The computer 16 has three functions. A first function is a function to mask a background portion of the golf ball which excludes the background material in a black color in the images transmitted from the camera 12 trough image processing. In this case, as is shown in FIG. 2, background portions 26 of the golf ball 10 which exclude the background material 14 are masked in black through image processing within the interior of the computer 16, whereby in the interior of the computer 16, the background portions of the golf ball in the images are turned into the dark color irrespective of actual colors of backgrounds, so that the computer 16 can be prevented from identifying erroneously a mark other than a target mark for analysis of the movement of the golf ball. In this case, a range where the golf ball resides or a range where the golf ball is anticipated to reside is set in advance, and only portions residing outside of the range so set may be masked in black. Note that the masking may be or may not be reflected on the monitor screen.

A second function of the computer 16 is a function to analyze the movement of the golf ball hit by the golf club based on the plurality of images 24. In this case, for example, a spin amount of the golf ball can be obtained from a variation in position between a letter, number or symbol printed on the golf ball detected from the image of the golf ball and the letter, number or symbol printed on the golf ball subsequently detected from the subsequent image. In addition, a speed of the golf ball can be calculated by identifying the contour of the golf ball shown on each image and by calculating a traveling amount of a predetermined location of the contour of the golf ball from a position in the image of interest to a position in the image following the image of interest. In addition, as is shown in FIG. 2, an angular velocity of the golf ball can be obtained from a change in angle formed by two points 28, 28 at both ends of the golf ball and a horizontal axis by identifying automatically the two points 28, 28 at both the ends of the golf ball and calculating a middle point of the two points and obtaining a locus and speed of the golf ball from coordinates of the middle point 30 of the respective images.

A third function of the computer 16 is a function to output the images of the golf ball and the results of the analysis of the movement of the golf ball to the monitor and/or a printer.

Although not shown, in the apparatus of this embodiment, a light source is installed for shining a light on to the golf ball, whereby a reference scale (which will be described later) and the golf ball are allowed to be imaged sharper. Although the apparatus of this embodiment needs no powerful light source such as an electronic flash because the apparatus is adapted to take images of a golf ball which is hit by a putter, light sources are preferably disposed in such a manner as to illuminate a golf ball from a plurality of directions so that no shadow of the golf ball is imaged together. As this actually occurs, it is good to shine light on to the golf ball from positions which lie at the same height of the golf ball or therebelow. This is because a lower part of the golf ball tends to be shaded due to the golf ball being a sphere. In addition, when imaging a golf ball hit by a putter, not a fluorescent lamp but an incandescent lamp or a halogen lamp is preferably used as the light source. In the case of the fluorescent lamp, electrons which flow as a result of electric discharge collide against atoms of mercury within a fluorescent lamp tube to thereby produce ultraviolet rays. Then, when the ultraviolet rays are shone on to the fluorescent material, visible rays are produced. Due to this, in high speed imaging, the monitor screen becomes brighter or darker to thereby become unstable, which is not preferred. On the other hand, in the incandescent lamp, an electric light is caused to flow through a tungsten filter, which is then heated to 2000° C. or higher due to the electrical resistance that the filament possesses to become incandescent, whereby a slightly reddish white light is emitted. In this way, since the filament itself emits the white light, stable light can be obtained. In addition, the halogen lamp emits light by a coiled filament being heated in the same manner as that of that of general electric lamps. In the general electric lamps, tungsten is gradually evaporated from the highly heated filament to adhere to the bulb, whereby a blackening phenomenon is produced in the lamp to reduce luminous flux to be emitted. In the halogen lamp, however, evaporated tungsten is combined with atoms of halogen by the action of halogen elements sealed in a bulb, so as to prevent the adhesion of evaporated tungsten to the bulb. By this means, the reduction in luminous flux in association with hours of illumination can be suppressed while luminous efficiency is increased, thereby making it possible to realize a long-life light source. In halogen lamps, there is a double-base halogen lamp which is a thin elongated lamp resembling the form of a fluorescent lamp. By making use of this, a rolling golf ball can be illuminated with a uniform brightness along the path thereof.

Next, an example will be described in which a movement of a golf ball hit by a putter was measured using the apparatus shown in FIG. 1. In this case, a lens whose focal length was 8 mm and speed was F 1.3 was used as the lens of the camera 12. In addition, 250 images per second of the golf ball hit by the putter were imaged by the camera. In this example, a movement of the golf ball was measured in the following procedure.

Figure 3:
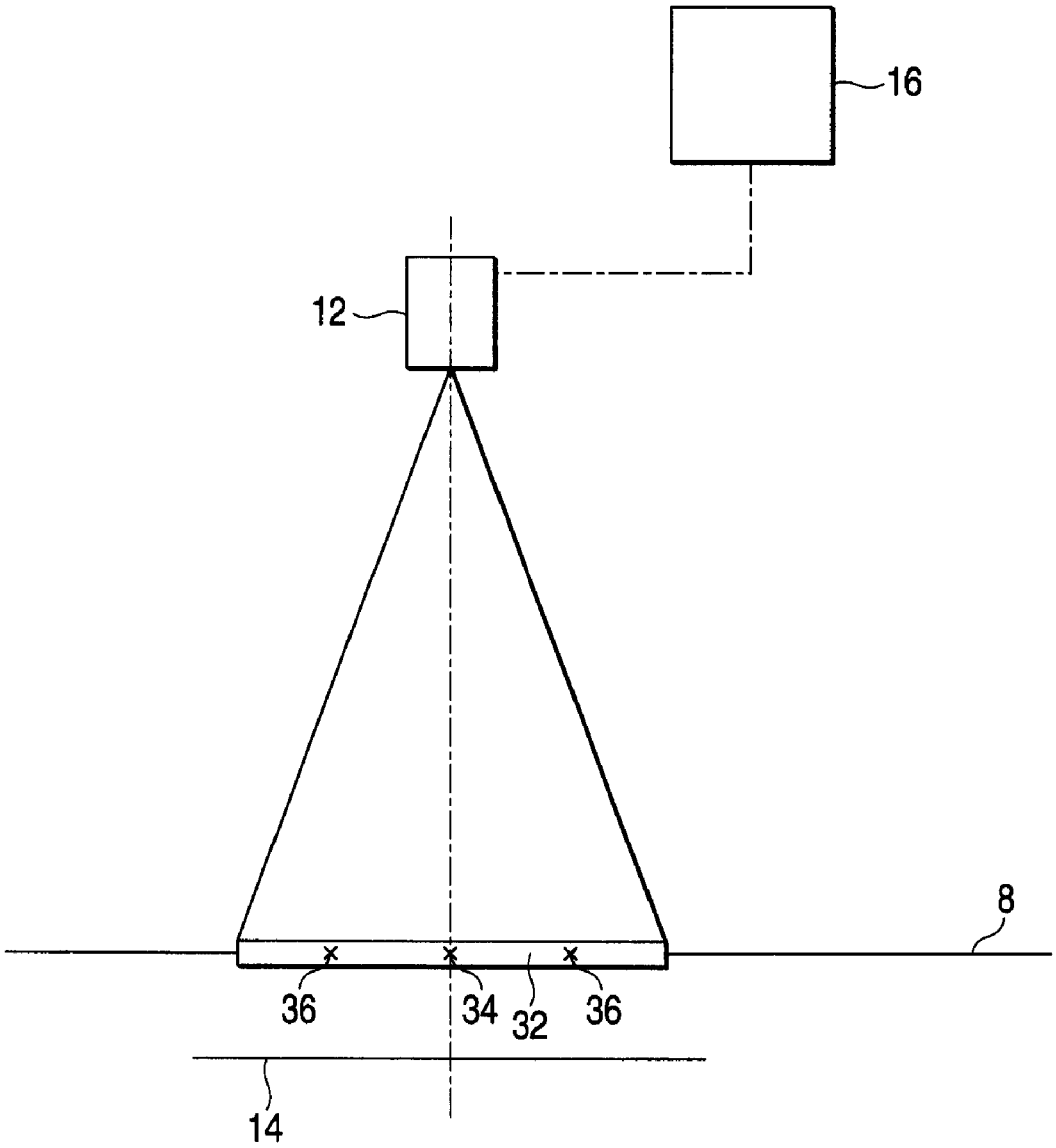
FIG. 3 is a layout diagram showing a state as viewed from the top in which a reference scale is installed on the apparatus shown in FIG. 1.
Figure 4:
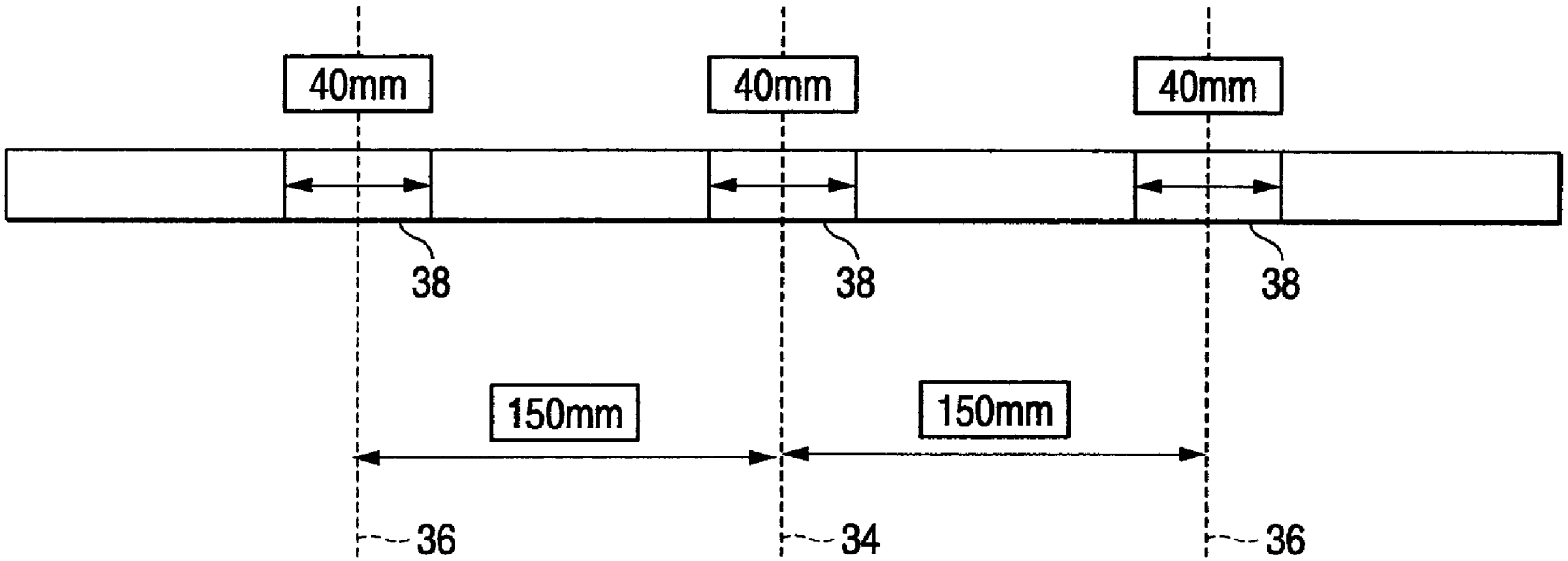
FIG. 4 is a diagram showing ranges of a length on the reference scale which are made to be stored in a computer.
Figure 5:
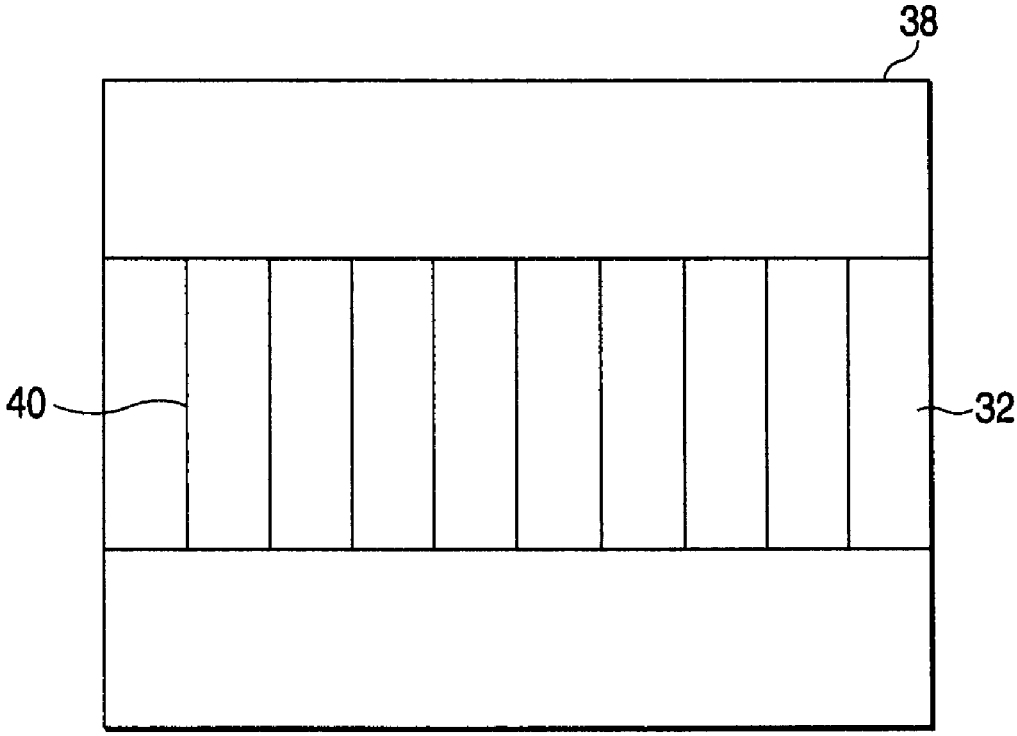
FIG. 5 is a schematic diagram showing a monitored image of the reference scale.

Operations for storing distances and angles in image data in the computer 16 were carried out before measurement. Specifically, as is shown in FIG. 3, an elongated reference scale 32 having a square cross section and graduations provided thereon was installed along an imaginary line 8 in such a manner as to include a position where a golf ball was to be disposed. An image of the reference scale 32 was imaged by the camera 12, and the image was transmitted to the computer 16 so as to store positions of a plurality of points on the reference scale 32 in the computer 16. Specifically, as is shown in FIG. 4, ranges 38 each extending over a distance of 40 cm were made to be identified by the computer 16 at three points; a position 34 which lay normal to a central point of the camera lens and positions 36, 36 which lay apart 150 mm apart from the position 34 to the left and right. The reason the ranges 38 extending over the length of 40 cm are made to be stored in the computer 16 is that since images are distorted by the lens and the like, ranges of a suitable distance are made to be stored in the computer 16 at the respective points, so as to carry out a length correction. By this having been so done, a reference for distance could be obtained. In addition, by making use of this reference scale 32, a horizontal axis was made to be stored in the computer 16. A monitor image 38 which captured the reference scale 32 is shown in FIG. 5. In the figure, reference numeral 40 denotes a portion corresponding to a graduation on the reference scale 32. In addition, within the computer 16, portions lying outside of the reference scale 32 were masked in black through image processing.

A golf ball 10 was set in the location shown in FIG. 1, the golfer putted the golf ball 10 with his or her putter, and 250 images per second of the golf ball so putted were imaged by the camera 12. Then, the images were transmitted directly to the computer 16 by way of no external memory.

Figure 6:
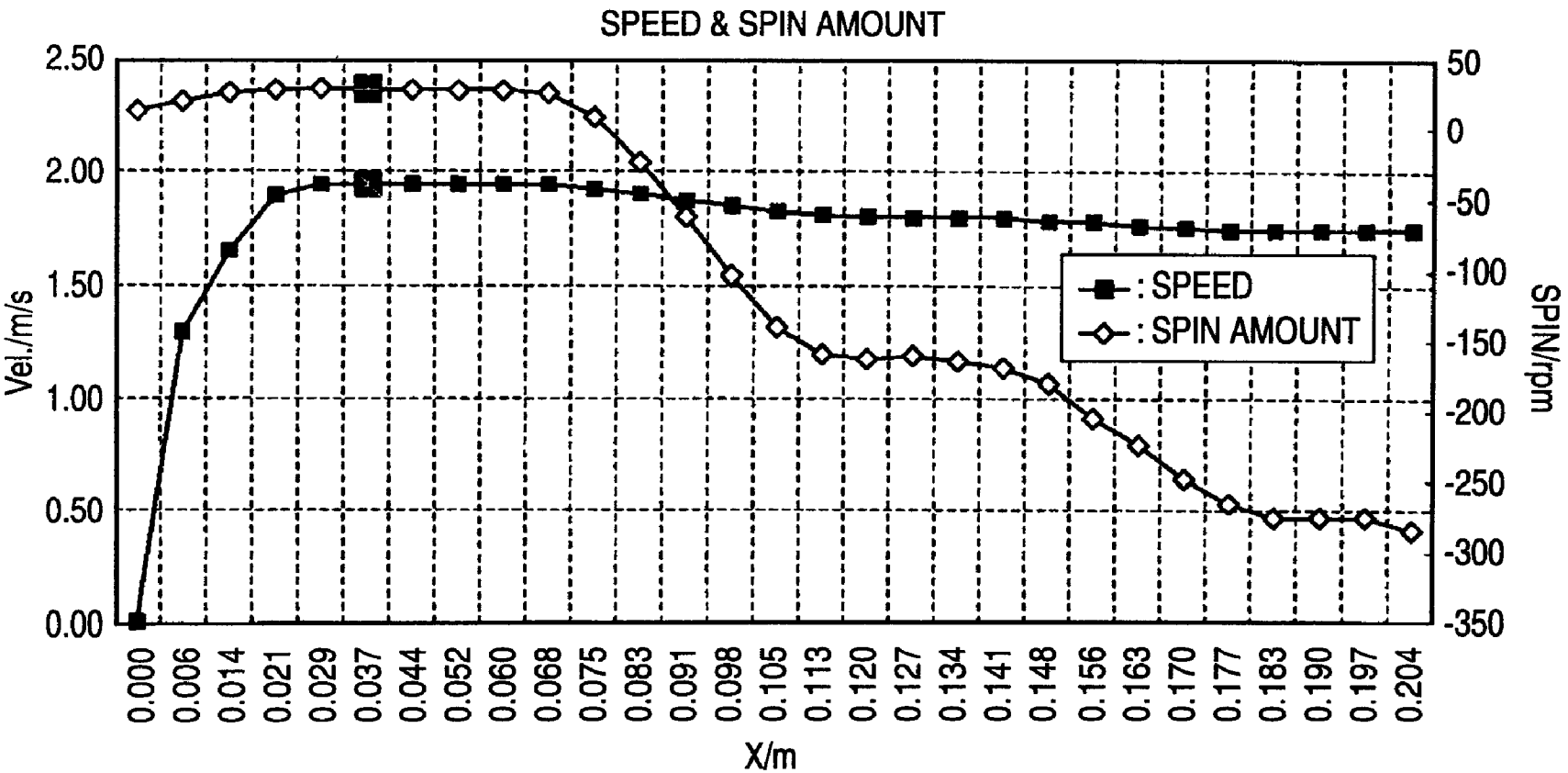
FIG. 6 is a graph showing a speed and angular velocity of the golf ball.
Figure 7:
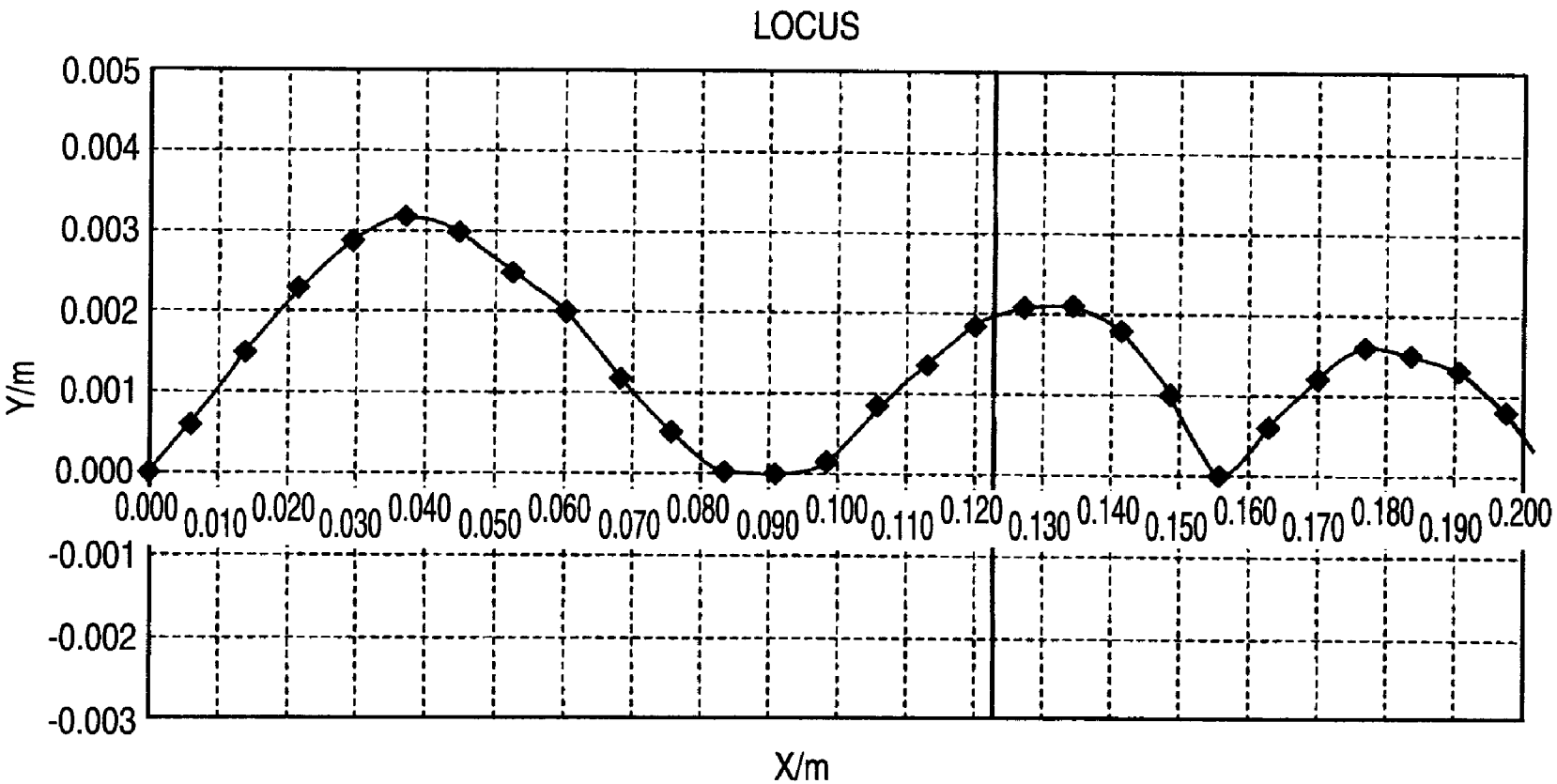
FIG. 7 is a graph showing a locus of the golf ball.

The movement of the golf ball was analyzed based on the images by the computer 16 in the way that has been described above, and the results of the analysis were displayed on the monitor. In this example, as is shown in FIG. 2, the two points 28, 28 lying at the ends of the golf ball were automatically identified by the computer 16, a middle point 30 of these points was calculated, a locus and speed of the golf ball were obtained from coordinates of the middle point 30 detected at respective times and were shown in a graph, and an angular velocity of the golf ball was obtained from a change in angle formed by the two points 28, 28 lying at the ends of the golf ball and the horizontal axis and was shown in a graph. The graphs are shown in FIGS. 6 and 7, respectively.

What is claimed is:

1. A golf ball movement measuring apparatus comprising:

a camera for taking a plurality of images of a golf ball hit by a golf club;

a dark-colored background material which is disposed so as to configure a background of the golf ball in the images;

a processing unit which receives the images taken by the camera, the processing unit masking a background portion, except for the dark-colored background material in the images, into a dark color through image processing, and the processing unit analyzing a movement of the golf ball hit by the golf club;

a first distance between the golf ball and the camera is about 700 to 900 mm;

a second distance between a center of the golf ball and a center of the camera is about 120 to 140 mm; and a third distance between the center of the golf ball and the dark-colored background material is about 110 to 130 mm, wherein the dark-colored background material is disposed to prevent the processing unit from falsely recognizing the golf ball, wherein the golf club is a putter, wherein the plurality of images comprise a moving image.

2. The golf ball movement measuring apparatus according to claim 1, wherein the camera is a high-speed video camera which takes 150 to 350 images per second.

3. The golf ball movement measuring apparatus according to claim 1, further comprising a light source for shining a light on to the golf ball, wherein the light source includes at least one of an incandescent lamp and a halogen lamp.

4. The golf ball movement measuring apparatus according to claim 1, wherein the background is masked by turning the background portion, except for the dark-colored background, into black.

5. The golf ball movement apparatus according to claim 1, wherein the processing unit analyzes the movement of the golf ball using an image of a predetermined reference scale captured by the camera.

* * * * *